US005550722A

United States Patent [19]

Bouwman et al.

[11] Patent Number: 5,550,722

[45] Date of Patent: Aug. 27, 1996

[54] ELECTRIC LAMP

[75] Inventors: Lambertus J. M. Bouwman, Eindhoven; Guillaume M. P. G. Hermes, Terneuzen; Cornelis J. Janson, Eindhoven, all of Netherlands

[73] Assignee: U.S. Philips Corporation, New York, N.Y.

[21] Appl. No.: 105,205

[22] Filed: Aug. 10, 1993

[30] Foreign Application Priority Data

Aug. 10, 1992 [EP] European Pat. Off. ..... 92202455

[51] Int. Cl.[6] ..... F21V 23/02

[52] U.S. Cl. ..... 362/221; 362/265; 313/318.03; 439/613

[58] Field of Search ..... 439/611, 613, 439/614, 615; 313/318; 362/216, 221, 226, 263, 265, 267

[56] References Cited

U.S. PATENT DOCUMENTS

| | | | |
|---|---|---|---|
| Re. 18,974 | 10/1933 | Smally | 439/615 |
| 2,999,220 | 9/1961 | Werner | 313/318 |
| 3,315,216 | 4/1967 | Krupp et al. | 313/318 |
| 4,495,443 | 1/1985 | Cummings | 315/58 |
| 4,660,906 | 4/1987 | Haraden | 439/611 |
| 4,920,297 | 4/1990 | Van der Heijden et al. | 313/318 |
| 4,939,420 | 7/1990 | Lim | 313/318 |
| 5,032,759 | 7/1991 | Thiry et al. | 439/613 |

FOREIGN PATENT DOCUMENTS 0156439 6/1990 European Pat. Off. .

*Primary Examiner*—Ira S. Lazarus
*Assistant Examiner*—Alan B. Cariaso
*Attorney, Agent, or Firm*—Brian J. Wieghaus

[57] ABSTRACT

An electric lamp including a light source, a lamp cap having a shell and a base, a housing connected to the light source and to the lamp cap, and a ballast which is electrically connected to the light source for operating the light source and which is arranged at least partly in a space surrounded by the housing and the lamp cap. The lamp cap includes contacts electrically connected to the ballast at least during lamp operation, one of said contacts being provided on the base and a further one on the shell. The further contact is formed by a band of conducting material around the lamp cap, which band directly adjoins the base at one side and adjoins a band of insulating material around the lamp cap at another side. This suppresses the interference generated in the supply mains, due to capacitive coupling between the ballast and the further contact, to a considerable degree.

9 Claims, 2 Drawing Sheets

ELECTRIC LAMP

BACKGROUND OF THE INVENTION

The invention relates to an electric lamp comprising a light source provided with a discharge vessel which is sealed in a gastight manner and which transmits radiation, a lamp cap having a shell and a base, a housing connected to the light source and to the lamp cap, ballast means which are electrically connected to the light source for operating the light source and which are arranged at least partly in a space surrounded by the housing and the lamp cap, and contacts which are connected with electrical conduction to the ballast means at least during lamp operation, one of said contacts being provided on the base and a further one on the shell.

Such an electric lamp is known from European Patent Application 156439. The known lamp is designed for use in the same applications in which traditionally an incandescent lamp was used. A major advantage of the known lamp over an incandescent lamp is that the luminous efficacy of the known lamp is considerably higher than the luminous efficacy of an incandescent lamp. A disadvantage, however, is the fact that the length of the known lamp is greater than that of an incandescent lamp, so that the known lamp is less suitable as a replacement for an incandescent lamp in some applications. It is accordingly desirable to reduce the length of the known lamp in order to increase the range of application of this lamp. A further reduction in the length of the lamp, however, is often accompanied by a size reduction of the housing, whereby the capacitive coupling between the ballast means often present in the housing and the contacts on the lamp cap increases. This capacitive coupling increases even further when the ballast means are partly provided in the lamp cap in order to facilitate a further size reduction of the lamp. The ballast means may consist, for example, of a coil when the electric lamp is operated with a current whose frequency is identical to that of the mains voltage with which the lamp is supplied. In that case there is a low-frequency lamp operation. Alternatively, however, the ballast means may comprise a circuit arrangement for generating a high-frequency current from the mains voltage, with which the electric lamp is supplied, for operating the electric lamp. In the latter case there is a high-frequency lamp operation. The frequency of the high-frequency lamp current is often of the order of 10 kiloHerz. Owing to the increased capacitive coupling between the ballast means and the contacts of the lamp cap, the ballast means cause a comparatively high degree of interference in the supply voltage mains during lamp operation, especially when the electric lamp is operated at a high frequency.

SUMMARY OF THE INVENTION

The invention has for its object inter alia to provide an electric lamp of a comparatively small length which causes a comparatively low degree of interference in the supply voltage mains during lamp operation.

According to the invention, this object is achieved in an electric lamp of the kind mentioned in the opening paragraph in that the further contact is formed by a band of conducting material around the lamp cap, which band directly adjoins the base at one side and adjoins a band of insulating material around the lamp cap at another side.

In the known electric lamp, the further contact extends over substantially the entire surface area of the lamp cap shell. Such a comparatively large surface area of the further contact causes a comparatively strong capacitive coupling between the further contact and the ballast means. In an electric lamp according to the invention, however, the size of the further contact is much smaller than in the known lamp. In addition, the further contact is arranged at a comparatively great distance from the space surrounded by the housing and from a major portion of the space surrounded by the lamp cap since this contact directly adjoins the base. This comparatively great distance and the considerably smaller size of the further contact have the result that the capacitive coupling between the ballast means and the further contact is much weaker. This leads to a considerable decrease of the interference in the supply voltage mains caused by the electric lamp during lamp operation. Especially when the ballast means comprise a circuit arrangement for generating a high-frequency current from the mains voltage, a comparatively strong decrease of the interference in the supply voltage mains was found.

The shell of the lamp cap of the known lamp is made from metal, so that the shell at the same time constitutes the further contact. Since the further contact of an electric lamp according to the invention, however, does not extend over substantially the entire external surface area of the lamp cap shell, but only over a comparatively small portion of the lamp cap, the idea suggests itself to manufacture the lamp cap from an insulating synthetic material and to provide the contact thereon. Since the housing of the electric lamp is also preferably manufactured from a synthetic material, it is possible to integrate the lamp cap and the housing of an electric lamp according to the invention into one component made of synthetic material. As a result, such a lamp comprises fewer components and,the assembling costs of these lamp components are strongly reduced.

To increase the mechanical strength of the lamp cap of an electric lamp according to the invention, it is possible to form part of the surface of the shell from metal which is electrically insulated from the contacts.

BRIEF DESCRIPTION OF THE DRAWINGS

Embodiments of the invention will be explained with reference to a drawing, in which.

DESCRIPTION OF THE PREFERRED EMBODIMENT

Figure 1A:
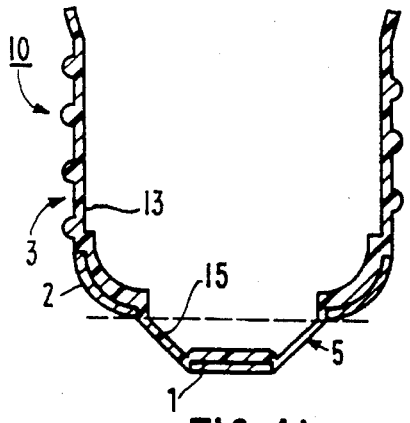
FIGS. 1A and 1B show two different embodiments of a lamp cap suitable for use in an electric lamp according to the invention.
Figure 1B:
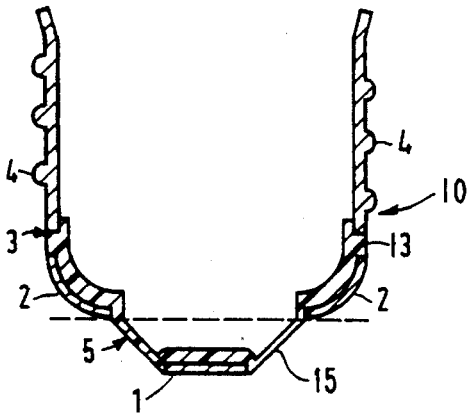

The lamp caps 10 shown in FIGS. 1*a* and 1*b* are both of the Edison type. The shell is threaded for fastening the lamp cap in a lampholder. In both Figures, 5 denotes the base of the lamp cap, 1 denotes the first contact and 2 the further contact. The boundary between base and shell is indicated with a broken line. In FIG. 1*a*, the lamp cap has a shell 3 and a base 5. The shell 3 includes threaded portion 13 of resin material and a metal contact 2 fixed therein and the base 5 includes a portion 15 of resin material and the first metal contact 1. The portions 13 and 15 form a single integrally molded part of synthetic material. In FIG. 1*b* the shell 3 is formed by the circumferential band of insulating resin matertial and the component 4 formed from metal which is electrically insulated from the first contact 1 and the further, second contact 2. The portion 3 in FIG. 1B also forms a single with the base 5 of the lamp cap. The lamp cap shown in FIG. 1*b* has an enhanced mechanical strength compared with the lamp cap shown in FIG. 1*a*. Although there is a certain degree of capacitive coupling between contact 2 and component 4 in a lamp cap as shown in FIG. 1*b*, practically no difference in the interference caused in the supply mains at an operating frequency of the order of 10 kHz was found between electric lamps provided with a lamp cap as shown in FIG. 1*a* and electric lamps provided with a lamp cap as shown in FIG. 1*b*.

It is obviously possible to apply the invention to lamp caps other than those of the Edison type such as, for example, bayonet type lamp caps.

Figure 2:
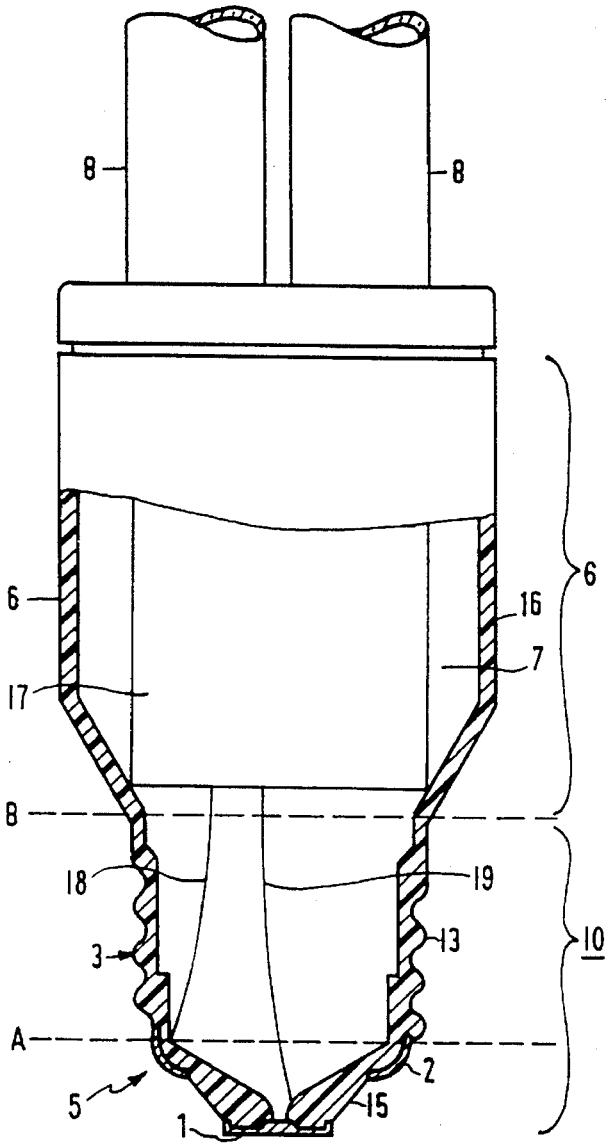
FIG. 2 shows an electric lamp according to the invention in side elevation, partly in cross-section.

In FIG. 2, components corresponding to the components of the lamp caps shown in FIG. 1 have the same reference numerals as in FIG. 1. Reference numeral 6 denotes the housing and reference numeral 16 denotes the wall of the housing. A and B are boundary planes, indicated with broken lines, between the shell 3 and the base 5 of the lamp cap 10 and between the lamp cap 10 and the housing, 6 respectively. It can be seen that the housing wall 16 and the portions 13 and 15 of the lamp cap have been integrated into one unit formed from synthetic resin. 7 denotes the space surrounded by the housing and the lamp cap in which ballast means, 17 for example comprising a circuit arrangement for generating a high-frequency current for operating the light source, are accommodated, and 8 denotes a discharge vessel which forms part of the light source, which is sealed in a gastight manner and which transmits radiation. The ballast 17 is connected to the first and second contacts 1, 2 by inductive leads 18, 19 and the discharge vessel in a well known manner (not shown).

Figure 3A:
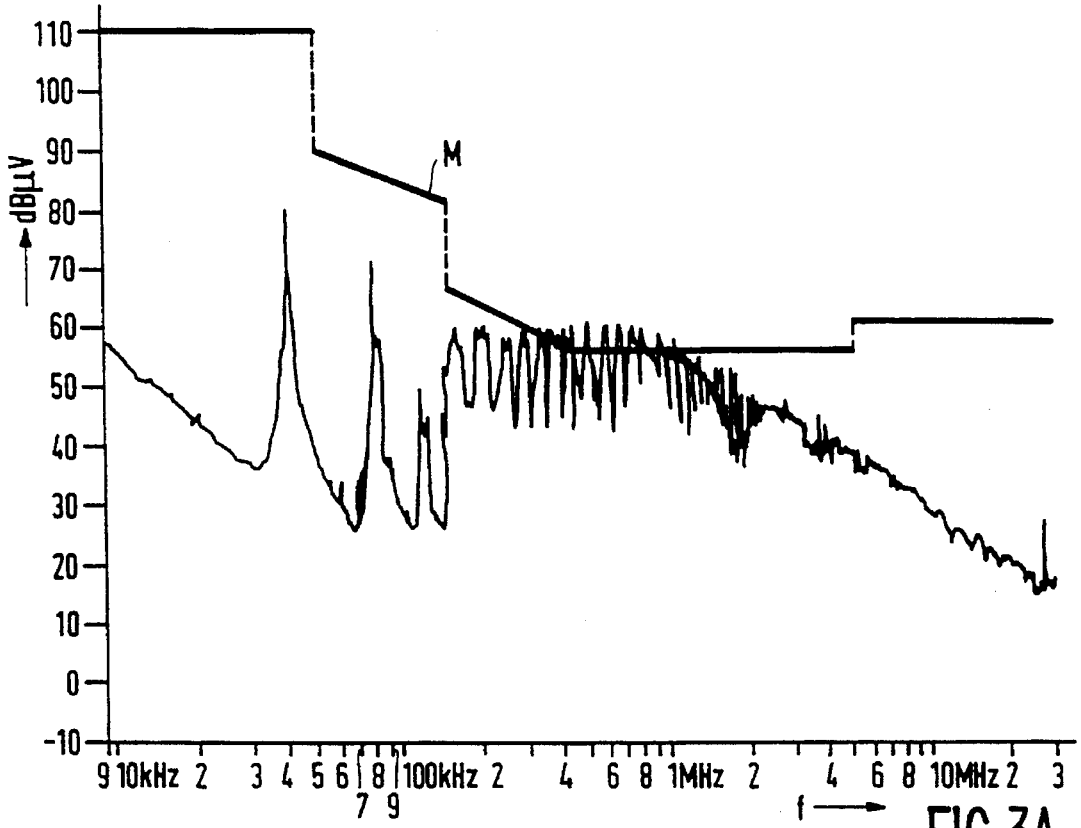
FIGS. 3A and 3B show a frequency spectrum of the intensity of the interference in the supply mains caused by an electric lamp according to the invention and a frequency spectrum of the intensity of the interference in the supply mains caused by an electric lamp provided with a lamp cap whose shell was completely formed from metal.
Figure 3B:
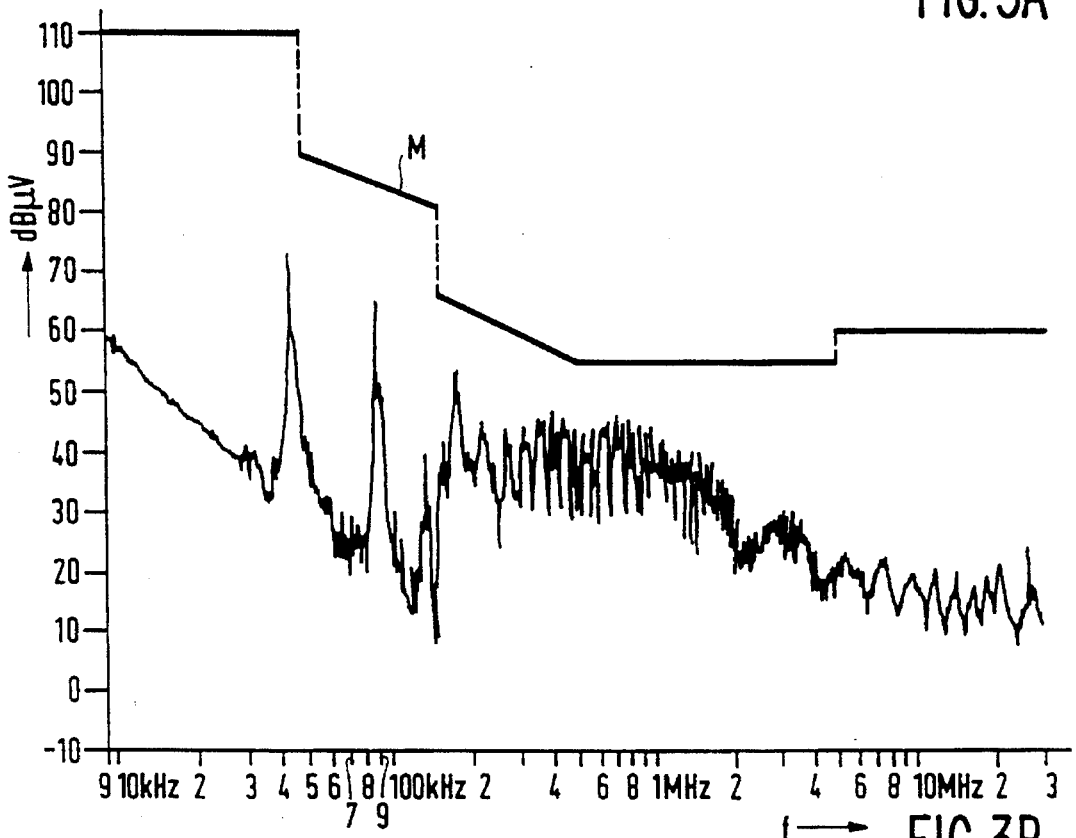

FIG. 3 shows two frequency spectra of the interference caused by two compact low-pressure mercury lamps of a power rating of 11 W in the supply mains. The low-pressure mercury lamps were operated at a frequency of 45 kHz. The power of the interference caused is indicated on the vertical axis in decibels. The frequency is plotted on the horizontal axis in MHz. It is also shown in both frequency spectra by means of the curve M how great the intensity of the interference caused is allowed to be at most according to the CISPR standard. The first lamp provided with a lamp cap of the Edison type whose shell was completely formed from metal yielded a frequency spectrum of the interference caused by the lamp in the supply mains as indicated in FIG. 3*a*. It is apparent that the maximum admissible interference is widely exceeded, especially in the frequency range from 300 kHz to 1 MHz. FIG. 3*b* shows the frequency spectrum of the interference generated in the supply mains by a lamp according to the invention. This second lamp was provided with a lamp cap as shown in FIGS. 1*a* and 2. It is visible from FIG. 3*b* that the interference caused by a lamp according to the invention lies below the maximum admissible value throughout the entire frequency range.

We claim:

1. An electric lamp, comprising:

a) a light source which is energizable for emitting light;

b) a housing having a first end holding said light source and an opposing, second end;

c) a lamp cap arranged at said second end of said housing and enclosing a space with said housing, said lamp cap comprising a base portion and a shell portion, said shell portion disposed between said base portion and said housing, said base portion carrying a first electrical contact and said shell portion carrying a second electrical contact, said second electrical contact comprising a band of conducting material circumferentially extending about said shell portion, said band being located at the end of said shell portion remote from said housing and having an axial dimension substantially smaller than the axial length of said shell portion, and said base portion and said shell portion each comprising a circumferential band of insulating material at opposing axial sides of said band of conductive material which comprises said second electrical contact; and d) a ballast for operating said light source, said ballast being disposed within the space enclosed by said housing and said lamp cap and being electrically connected to said light source and to said first and second contacts.

2. An electric lamp as claimed in claim 1, characterized in that the ballast means comprise a circuit arrangement for generating a high-frequency lamp current from a supply voltage.

3. An electric lamp as claimed in claim 1 or 2, characterized in that the lamp cap and the housing are integrated into one component formed from synthetic resin.

4. An electric lamp as claimed in claim 3, characterized in that part of the surface of the shell is made of metal which is electrically insulated from the contacts.

5. An electric lamp as claimed in claim 2, characterized in that part of the surface of the shell is made of metal which is electrically insulated from the contacts.

6. An electric lamp as claimed in claim 1, characterized in that part of the surface of the shell is made of metal which is electrically insulated from the contacts.

7. An electric lamp, comprising:

a) a light source which is energizable for emitting light;

b) a housing having a first end holding said light source and an opposing, second end;

c) a lamp cap arranged at said second end of said housing and enclosing a space with said housing, said lamp cap comprising a base portion and a shell portion, said shell portion disposed between said base portion and said housing, said shell and base portions being comprised of a synthetic electrically insulative resin material, said shell portion being generally cylindrical and terminating at an end remote from said housing, said end comprising a rounded shoulder, said base portion extending from said rounded shoulder with a truncated conical shape with the narrowest diameter at one end remote from said shell portion, said base portion carrying a first electrical contact at said end remote from said shell portion, said rounded shoulder of said shell portion carrying a second electrical contact comprising a rounded band of conducting material circumferentially extending about said shoulder, said rounded band of conducting material having a dimension in the axial direction which is substantially smaller than that of the shell portion, and said base portion and said shell portion each comprising a circumferential band of said synthetic electrically insulative resin material at opposing axial sides of said rounded band of conductive material; and d) a ballast for operating said light source, said ballast being disposed within the space enclosed by said housing and said lamp cap and being electrically connected to said light source and to said first and second contacts.

8. An electric lamp according to claim 7, wherein said shell portion includes a metallic threaded part separated from said second electrical contact by a said band of electrically insulative resin material.

9. An electric lamp according to claim 8, wherein said housing is comprised of said synthetic electrically insulating resin material and is an integrally molded part with said shell and base portions of said lamp cap.

* * * * *